United States Patent [19]

Leifeld

[11] Patent Number: 4,779,311

[45] Date of Patent: Oct. 25, 1988

[54] METHOD AND APPARATUS FOR FEEDING A PLURALITY OF TEXTILE FIBER PROCESSING MACHINES

[75] Inventor: Ferdinand Leifeld, Kempen, Fed. Rep. of Germany

[73] Assignee: Trützschler GmbH & Co. KG, Mönchen-Gladbach, Fed. Rep. of Germany

[21] Appl. No.: 53,337

[22] Filed: May 22, 1987

[30] Foreign Application Priority Data

May 24, 1986 [DE] Fed. Rep. of Germany ..... 3617526

[51] Int. Cl.[4] ..... D01G 23/06

[52] U.S. Cl. ..... 19/105; 19/106 R; 19/240

[58] Field of Search ..... 19/105, 106 R, 240

[56] References Cited

U.S. PATENT DOCUMENTS

| | | | |
|---|---|---|---|
| 4,321,732 | 3/1982 | Erben | 19/105 X |
| 4,506,413 | 3/1985 | Leifeld | 19/105 |
| 4,535,511 | 8/1985 | Leifeld et al. | 19/105 |
| 4,689,857 | 9/1987 | Pinto | 19/105 |

FOREIGN PATENT DOCUMENTS

| | | |
|---|---|---|
| 0329412 | 7/1975 | Austria . |
| 2359917 | 6/1974 | Fed. Rep. of Germany . |
| 2264299 | 9/1978 | Fed. Rep. of Germany . |
| 2835114 | 3/1979 | Fed. Rep. of Germany . |
| 3128564 | 2/1983 | Fed. Rep. of Germany . |
| 3239524 | 7/1983 | Fed. Rep. of Germany . |
| 3244619 | 10/1983 | Fed. Rep. of Germany . |
| 3513295 | 10/1986 | Fed. Rep. of Germany . |

*Primary Examiner*—Louis K. Rimrodt

*Attorney, Agent, or Firm*—Spencer & Frank

[57] ABSTRACT

A method of feeding a plurality of fiber processing machines with fiber tufts, including the steps of pneumatically advancing fiber tufts by a conveying fan within a first tuft confining device into a second tuft confining device associated with respective fiber processing machines; compressing the tufts in each second tuft confining device by a compressing air stream whereby a compressed tuft column having a height level is obtained in each second tuft confining device; and measuring and regulating the pressure in at least one of the tuft confining devices. The first tuft confining device comprises a tuft conveying duct and the second tuft confining devices are formed of tuft collecting chutes. Further, upon a change of fiber type to be processed and the resulting change of the height level in respective said tuft collecting chutes, the flow output rate of the compressing fan is altered until a predetermined height level of the fiber tuft column is reached; and the pressure corresponding to the predetermined height level is measured in the respective tuft collecting chute.

19 Claims, 4 Drawing Sheets

INPUTTING AND RETRIEVING DEVICE
MOTOR REGULATOR
MOTOR REGULATOR
ANALOG/DIGITAL CONVERTER
ANALOG/DIGITAL CONVERTER
PRESSURE MONITORING DEVICE
CONTROL APPARATUS
INTEGRATOR
MEMORY
SWITCH-OVER DEVICE
BALANCING DEVICE
REGULATING VALUE FORMER
SWITCH-OVER DEVICE
MEMORY
DESIRED VALUE FORMER
MICROCOMPUTER

METHOD AND APPARATUS FOR FEEDING A PLURALITY OF TEXTILE FIBER PROCESSING MACHINES

BACKGROUND OF THE INVENTION

This invention relates to a method and an apparatus for feeding a plurality of fiber processing machines, such as carding machines, rollercard units and the like wherein fiber tufts are pneumatically delivered through a tuft conveyor duct to a plurality of collecting chutes where the fiber tufts deposited therein are pneumatically compressed by a fan-generated air stream and wherein each chute has a predetermined fill level for the fiber material. The supply of fiber tufts to the collecting chutes is effected by a fiber tuft delivering apparatus wherein the pressure in the conveyor duct or in the collecting chute is sensed and regulated.

In order to be able to compress relatively large fiber tufts with a relatively low air resistance, a fan with a relatively high output is required. If in the same tuft feeder easily compressible tufts (relatively small fiber tufts) are to be processed and, in particular, if the machine should be able to operate with both types of fiber tufts in an alternating manner, according to a known method, at the beginning of the tuft processing, the setting of the pressure sensor which responds to the pressure in the collecting chute (filling chute or feed chute) is manually altered. The pressure sensor is connected by means of a regulator with the drive motor for the feed roller of the tuft feeder whereby the quantity of the fiber material supplied to the feed chute is varied. In such a mode of operation, the fill level of the fiber material column in the feed chute always varies which thus also means an alteration of the degree the air outlet openings provided in the feed chute are covered by the fiber material. It is a disadvantage of this arrangement that a deviation from an optimal fill level or optimal coverage of the air outlet openings for the best compression effect will occur.

SUMMARY OF THE INVENTION

It is an object of the invention to provide an improved method and apparatus of the above-outlined type from which the above-noted disadvantages are eliminated and which in particular permits a setting for an optimal pneumatic transport and/or compressing effect by the fans for a changed type of fiber material to be processed.

This object and others to become apparent as the specification progresses, are accomplished by the invention, according to which, briefly stated, upon a change of the type of fiber material to be processed, involving a change of the fill level in the collecting chute, the flow rate of the air delivered by the fan is varied until the predetermined desired fill level is reached and further, the pressure is measured for such fill level or flow rate.

A pressure seeking at the feed chute of the tuft feeder by monitoring the coverage of the air outlet openings with fiber material is simple, practical and advantageous, resulting in an unequivocal determination of the feed chute pressure. Considering the increased output of up-to-date machines the determination and setting of optimal operational conditions are particularly important. Controlled operational conditions in case of changing the type of the fiber material to be processed are possible in high output machines only by such self-setting. For this reason the rpm alteration of the densifying (tuft compressing) fan as a function of the extent of coverage of the air outlet openings of the tuft feeder is of importance. The invention provides for a self-seeking and self-determining desired value formulation for pressure and fan rpm.

Advantageously, in a method in which the pressure is measured by a pressure measuring device with settable desired pressure value, the measured pressure is used as a desired pressure value for setting the pressure measuring device. According to another advantageous feature of the invention, wherein the pressure in the collecting chute is transformed into an electric signal and applied to a regulating device which, upon deviation from a desired rpm value, changes the rpm of the drive motor for the device that transports the fiber tufts, the desired rpm value (base rpm) is set in the regulating device as a function of the desired pressure value.

The embodiment of the apparatus according to the invention is used in conjunction with fiber tuft feeders, each having an upper, reserve chute which communicates with a common tuft conveying duct (serving a plurality of feeders) and a lower, feed chute receiving fibers from the reserve chute by means of a feed roller. The feed chute is coupled to a fan driving a compressing air stream through the feed chute. In each feed chute a pressure sensor is arranged which is connected by means of a regulator with the drive of the feed roller for the feed chute and wherein within each feed chute there is arranged a fill-level measuring device which is connected by means of a regulator with the drive motor for the compressing fan and wherein the fill-level measuring device, the pressure sensor and the regulators are connected to a common control device.

Another embodiment of the apparatus according to the invention is used in conjunction with reserve chutes which are connected upstream of the respective individual cards or roller card units and which are coupled to a common tuft conveying duct which includes a conveying fan and which is connected with an upstream-arranged fiber processing machine such as a fine opener. In the tuft conveying duct there is arranged a pressure sensor which is connected by means of a regulator with a drive of the fiber processing machine. In each reserve chute there is arranged a fill-level measuring device which is connected by means of a regulator with a drive motor for a transport fan (generating a tuft-conveying air stream). The fill-level measuring device, the pressure sensor and the regulators are connected to a common control device. The self-setting of the operational conditions (fill-level, pressure) are effected in the reserve chute or in the feed chute of the fiber tuft feeder.

Preferably, the fill-level measuring device is formed of two superimposed sensors which are preferably optical barriers.

Preferably, at least one of the optical barriers is situated above the upper boundary of the air outlet openings of the reserve chute or the feed chute. Preferably, a desired pressure setting device is associated with the pressure measuring device, and a desired rpm-setting device is associated with the regulating device. According to a further advantageous feature of the invention, a computer is provided which includes the control device and the memory and the computer expediently comprises an rpm equalizing device. Preferably, the computer stores in a memory a desired fan rpm value which corresponds to a determined fill level in the tuft chute.

Preferably, the computer stores in a memory a desired value which corresponds to a certain fill level in the feed chute.

An alteration of the rpm's of all compressing fans may also be effected automatically in case the fill level in the tuft chute, for example, in the feed chute, particularly in the zone of the upper boundary of the air outlet openings, is monitored by means of at least one sensor. In case of a predetermined output rate which may be set, for example, by an rpm of the feed roller in the tuft feeder or the feed roller of the upstream-arranged opener or cleaner, the rpm of the fans is varied until the coverage of the air outlet openings by the fiber tufts in the tuft chute is optimal. In case two sensors (photocells) are used, it may be recognized whether the desired column level is excessively high or excessively low. In case both optical barriers are dark, the level is too high and in case neither optical barrier is dark, the column level is excessively low. The desired level is reached if only one of the optical barriers is dark. In case both optical barriers are dark, the fan rpm is decreased and if they are both light, the fan rpm is increased. This arrangement serves for finding the basic setting during production start for an automatic finding of the ideal operational conditions. This is particularly required if a machine or system is controlled by a microprocessor and all desired operational data are contained in a memory. The determined pressure in the tuft chute, for example, in the feed chute is used as the desired pressure for the tuft supply to the feed chute. After finding the ideal fan rpm the latter is no longer varied and is used as a fixed value. Thereafter, the desired pressure which sets itself accordingly in the feed chute, may be used as a desired value for the feed chute control.

The determination and release of desired values are effected essentially by a self-monitoring of the system. The position of the upper edge (top face) of the fiber tuft column with respect to the upper boundary of the air outlet openings in the fill chute is determined by means of sensors. For such a position an ideal value exists, and the deviations from this value are monitored over time and recorded. In case of exceeding or falling below the ideal value the fan rpm is corrected accordingly. If during a predetermined period the upper column edge is situated in the ideal zone, the pressure prevailing during such period is maintained fixed as a desired pressure and, similarly, the fan rpm present during such period is considered and used as a desired rpm. Further determinations are promptly discontinued, and normal regulation is put into effect, whereby for such normal regulation the determined desired values are utilized, including the desired value for the rpm.

DESCRIPTION OF THE PREFERRED EMBODIMENTS

Figure 1:
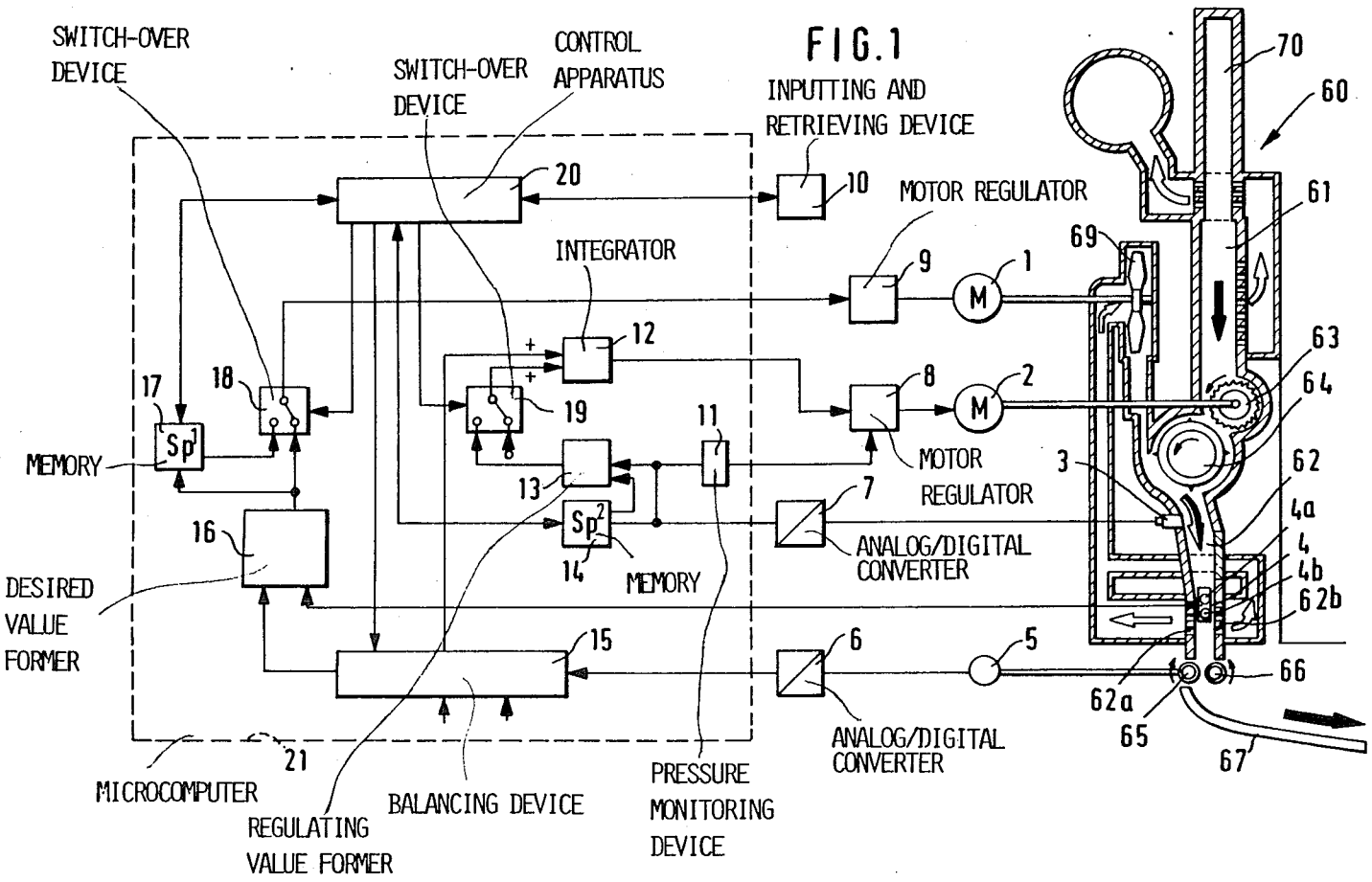
FIG. 1 is a schematic sectional side elevational view, with block diagram, of a first preferred embodiment of the invention associated with a feed chute of a card feeder.
Figure 2:
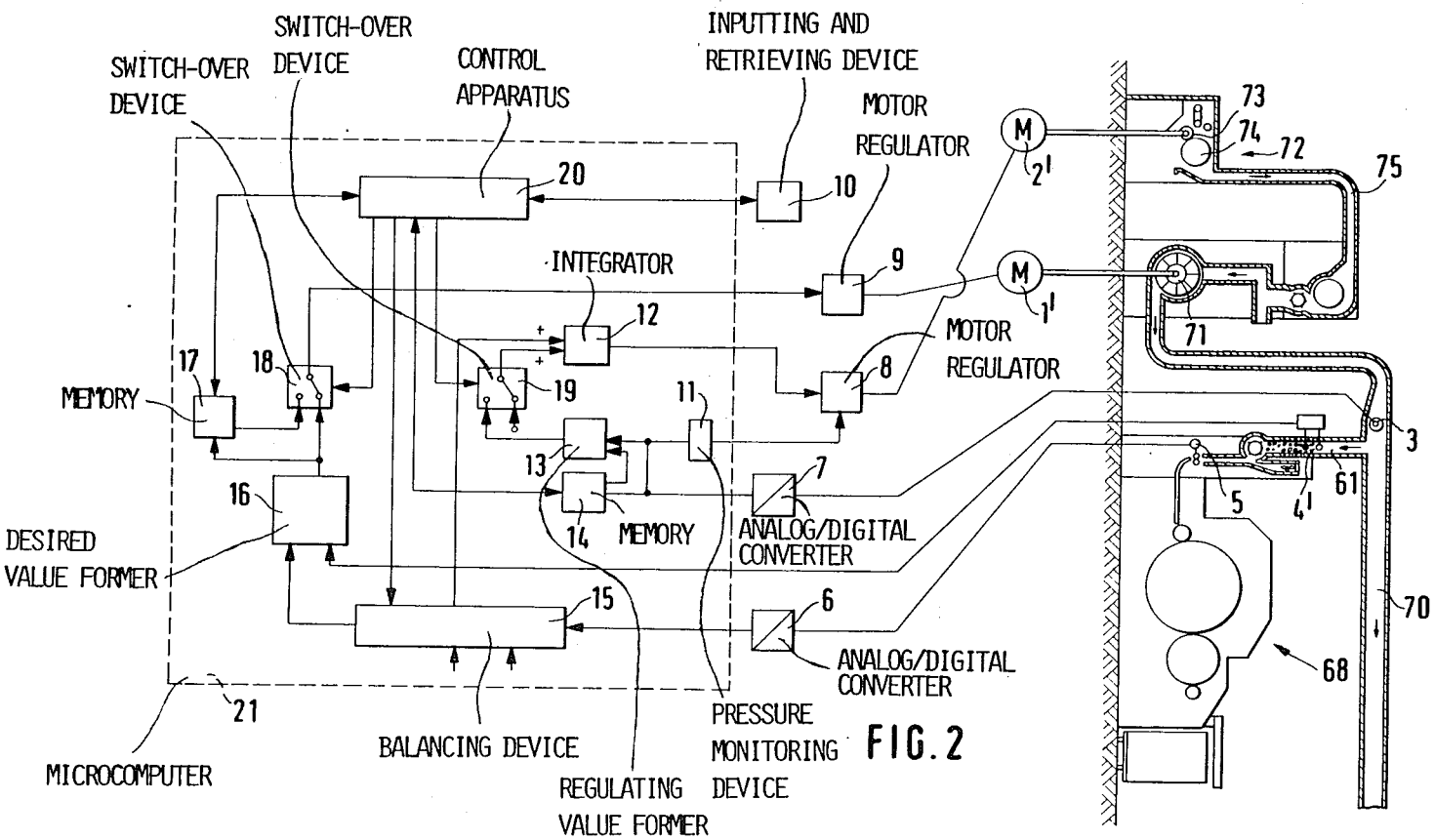
FIG. 2 is a schematic side elevational view (rotated 90° clockwise in the plane of the drawing), with block diagram, of a second preferred embodiment of the invention associated with a reserve chute of a card feeder.

Turning now to FIGS. 1 and 2, there is illustrated therein a known fiber tuft feeder 60 which may be, for example, an "EXACTAFEED FBK" model, manufactured by Trützschler GmbH & Co. KG, Mönchengladbach, Federal Republic of Germany, supplying a fiber lap to an after-connected known carding machine 68 such as, for example, a Trützschler "EXACTACARD DK 3". The tuft feeder 60 has an upper or reserve chute 61 and a lower or feed chute 62. Fiber material is advanced from the reserve chute 61 into the feed chute 62 by means of a feed roller 63 and an opening roller 64. At the lower, discharge end of the feed chute 62 there are provided cooperating discharge rollers 65, 66 which withdraw the fiber material (fiber lap) from the feed chute 62 and deposit it onto a feed tray 67, leading to the input of the card. The feed chute 62 is operatively coupled to a compressing fan 69 which generates an air stream that densifies (compresses) the fiber tuft column in the feed chute 62. The reserve chutes 61 of a plurality of tuft feeders 60 are connected to a common fiber tuft conveyor duct 70 which is connected with an upstream-arranged fine opener 72. In the conveyor duct there is arranged a conveyor fan 71. The fine opener 72 has a feed roller 73 and an opening roller 74 and is connected with the fan 71 by means of a duct 75.

Turning to the embodiment according to FIG. 1, in the feed chute 62 there is arranged a pressure-responsive device 3, such as an electronic pressure sensor which is connected by means of a regulator 8 with the drive motor 2 rotating the feed roller 63. Within the feed chute 62 there is arranged a fill-level measuring device 4 which is formed of two vertically spaced optical barriers 4*a*, 4*b*. The optical barrier 4*a* is situated above the upper boundary of the air outlet openings 62*a*, 62*b* of the feed chute 62. The fill-level measuring device 4 is connected by means of a regulator 9 with the drive motor 1 of the compressing fan 69. The fill-level measuring device 4, the pressure-responsive device 3 and the regulators 8 and 9 are connected to a common control device (process control device) 20 which is associated with an inputting and retrieving device 10.

The control apparatus 20 forms a component of a microcomputer 21 which may be a Trützschler TMS model including a Rockwell 6502 microprocessor. The control apparatus 20 is connected with a balancing (equalizing) device 15 for basic rpm values which, in turn, is connected by means of an analog-digital converter 6 with a tachogenerator responding to the rpm of the discharging roller 25. The balancing device 15 and the fill-level measuring device 4 are connected with a device 16 which forms a desired value for the rpm of the compressing fan 69. The device 16 is connected by means of a memory 17 for the optimal desired values of the rpm of the fan 69 with the control device 20 and, by means of a switchover device 18, with the motor regulator 9. Furthermore, the switchover device 18 is connected with the memory 17 and the control apparatus 20. An integrating device 12 is connected with the balancing device 15 and, by means of an analog/digital converter 7, with the pressure sensor 3. The integrator 12 is connected to the motor regulator 8 (controlling the motor 2 of the feed roller 63) to apply signals to the latter. Further, for the optimal pressure values there is provided a memory 14 which is connected with the control apparatus 20, the analog/digital converter 7 and a device 13 which forms a regulating value. Between the device 13 and the integrator 12 there is connected a switchover device 19 which, in turn, is connected with the control apparatus 20. Furthermore, a device 11 for pressure monitoring is provided which is connected with the regulating value forming device 13 and the motor regulator 8.

The electronic circuit illustrated in FIG. 2 corresponds to that shown in FIG. 1. The fill-level measuring device 4' is arranged in the zone of the air outlet openings 61*a*, 61*b* of the upper, reserve chute 61. The electronic pressure responsive device 3' is installed in the conveyor duct 70 in the vicinity of the reserve chute 61. A drive motor 1' rotates the fiber tuft conveying fan 71. The feed roller 73 of the fine opener 72 is rotated by a drive motor 2'.

Figure 3:
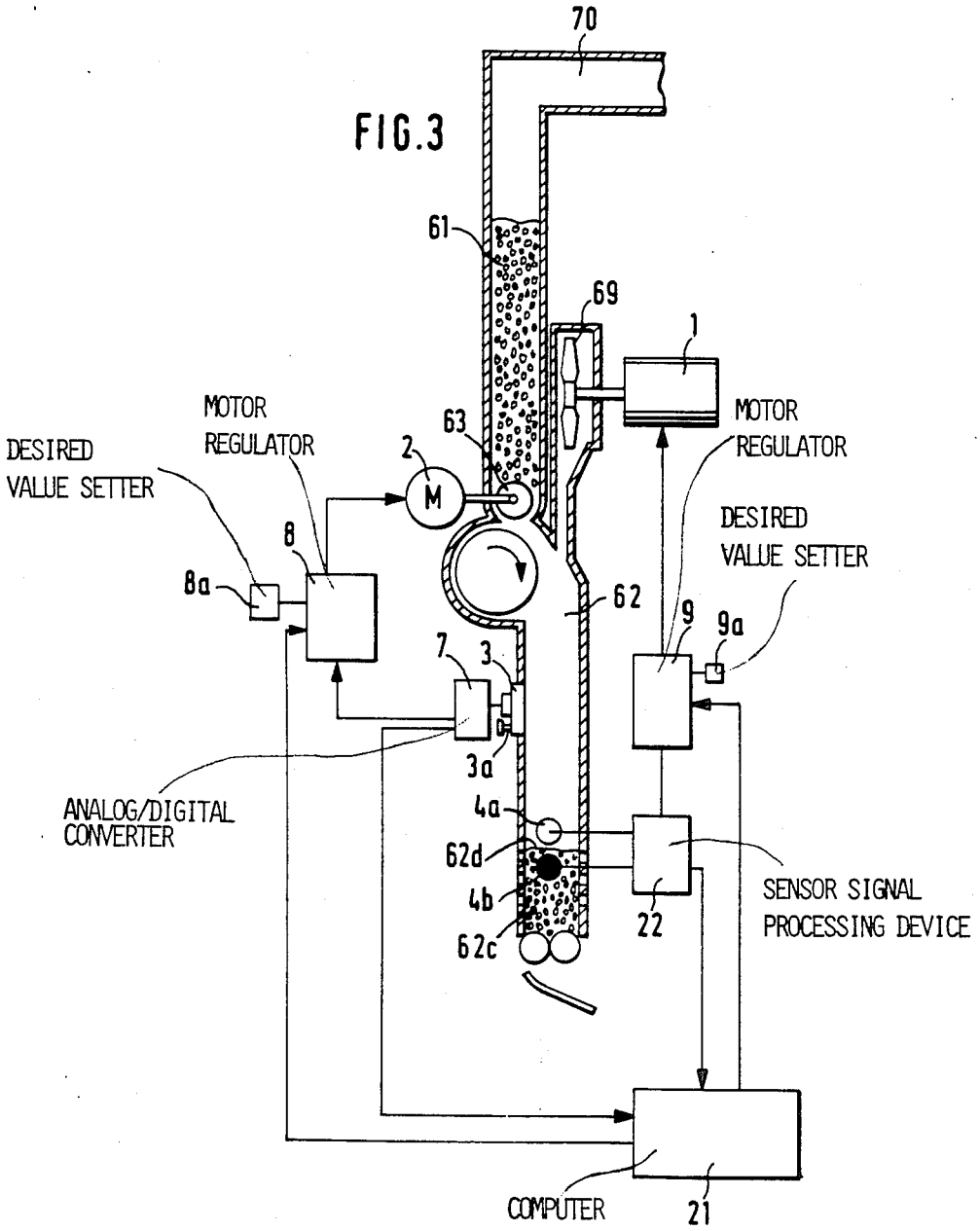
FIGS. 3 and 4 are constructions similar to FIGS. 1 and 2, respectively, shown further with a computer functioning as a common control device.

Turning to FIG. 3, within the feed chute 62 there are shown the optical barriers 4*a*, 4*b* between which there is situated the upper level (fill level) of the fiber tuft column 62*c*. The lower optical barrier 4*b* is dark. The optical barriers 4*a* and 4*b* are connected to a common device 22 for processing the electric signals emitted by the optical barriers. The device 22 is connected with the regulator 9 for the fan drive motor 1 and with the computer 21. The motor regulator 9 which may have a desired value setter 9*a* for manual operation, is connected with the computer 21 to effect an automatic operation. In the wall of the feed chute 62 there is installed the pressure-responsive device 3, equipped with a setting device 3*a* and connected, by means of the analog/digital converter 7, with the motor regulator 8 for the drive motor 2 of the feed roller 63 and with the computer 21. The motor regulator 8 which has a desired value setter 8*a* is connected with the computer 21 through which pressure regulation is effected.

Figure 4:
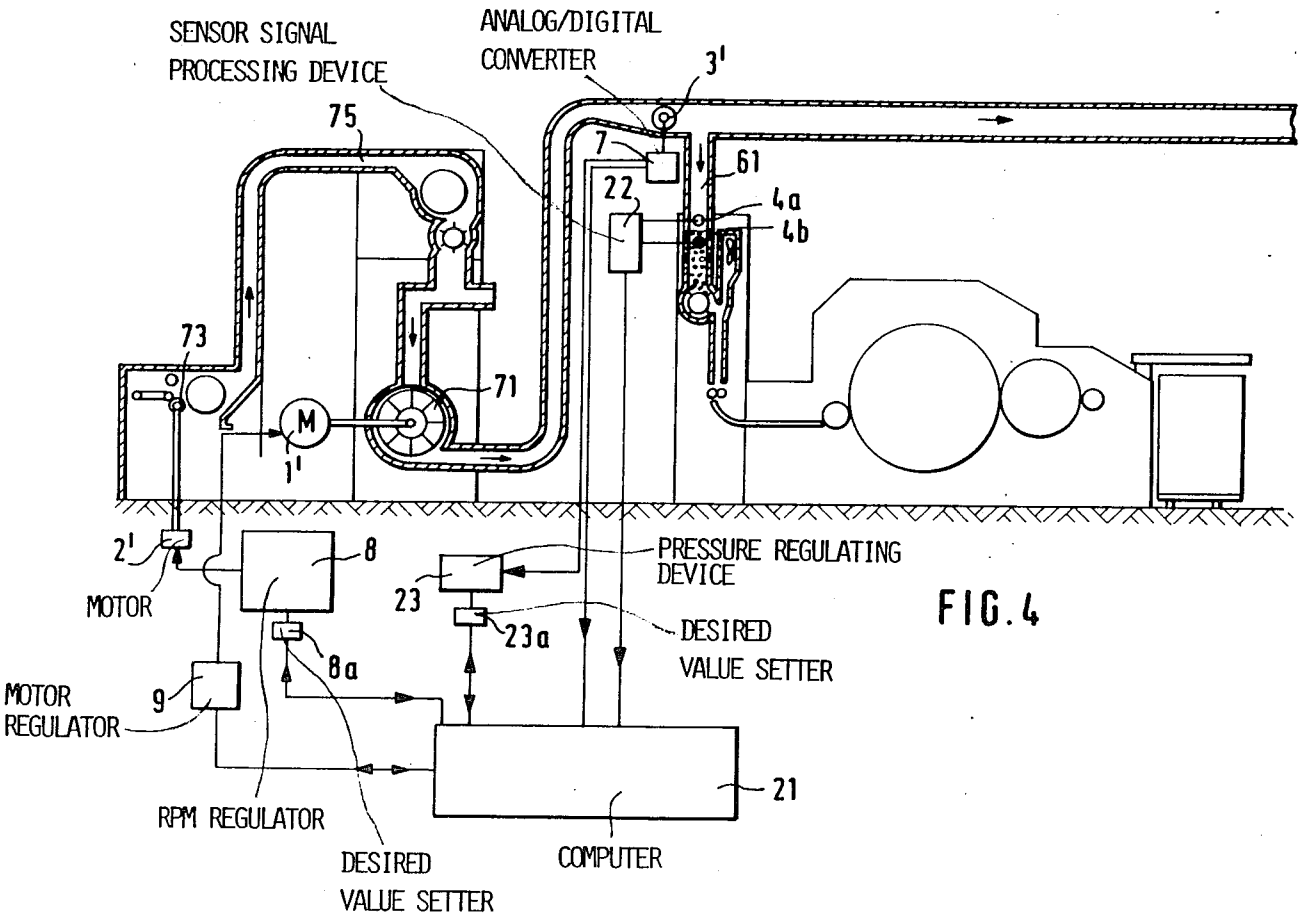

According to FIG. 4, within the reserve chute 61 there are shown the optical barriers 4*a*, 4*b* which are connected by means of a common device 22 to the computer 21. The pressure-responsive device 3' situated in the conveying duct 70 is connected by means of the analog/digital converter 7 with the computer 21 and is also connected with the pressure regulating device 23. The latter is connected by means of a desired value setter 23*a* with the computer 21. The rpm regulating device 8 for the drive motor 2' rotating the feed roller 73 is connected by means of a desired value setter 8*a* for the basic rpm, with the computer 21. The latter is also connected by means of the regulating device 9 with the drive motor 1' for the conveyor fan 71.

The present disclosure relates to subject matter contained in Federal Republic of Germany Patent Application No. P 36 17 526.9 (filed May 24th, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a method of feeding a plurality of fiber processing machines with fiber tufts, including the steps of pneumatically advancing fiber tufts by a conveying fan within a first tuft confining device into separate second tuft confining devices associated with respective said fiber processing machines; a fiber tuft delivering device feeding said second tuft confining devices; compressing the tufts in each second tuft confining device by a compressing air stream generated by a compressing fan, whereby a compressed tuft column having a height level is obtained in each said second tuft confining device; measuring and regulating the pressure in at least one of the tuft confining devices; said first tuft confining device comprises a tuft conveying duct and said second tuft confining devices being formed of tuft collecting chutes; the improvement comprising the following steps:

(a) upon a change of fiber type to be processed and the resulting change of the height level in respective said tuft collecting chutes, altering the flow output rate of at least one of the compressing fans until a predetermined height level of the fiber tuft column is reached; and (b) measuring the pressure in the respective tuft collecting chute, corresponding to the predetermined height level.

2. A method as defined in claim 1, further comprising the step of (c) using the pressure value obtained in step (b) as a desired pressure value for setting a pressure regulating device.

3. A method as defined in claim 1, further comprising the following steps:

(c) generating an electric signal representing the pressure in the tuft collecting chute;

(d) applying the electric signal to a regulating device;

(e) changing, by the regulating device, the rpm of a motor driving the fiber tuft delivering device; and (f) setting a desired rpm value in the regulating device as a function of said desired pressure value.

4. In an apparatus for feeding a plurality of fiber processing machines with fiber tufts, including a common fiber conveying duct, a conveyor fan connected with the duct and arranged for generating a tuft conveying air stream therein; a first motor drivingly connected to said conveyor fan; separate fiber lap feeders associated with respective said fiber processing machines; each fiber lap feeder having a reserve chute connected to said duct for receiving fiber tufts from said duct, a feed chute connected to the reserve chute, a feed roller arranged for advancing fiber tufts from the reserve chute into the feed chute, a second motor drivingly connected to said feed roller, a compressing fan connected with the feed chute and arranged for generating a compressing air stream and directing the compressing air stream into the feed chute for compressing the fiber tufts therein to form a fiber tuft column having a fill level, a third motor drivingly connected to said compressing fan, a pressure-responsive device situated in said feed chute, a first regulator connected to said pressure-responsive device and said second motor for regulating the rpm of said feed roller as a function of pressure in the feed chute; the improvement comprising (a) a fill-level measuring device situated in each said feed chute;

(b) a second regulator connected to said fill-level measuring device and said third motor for regulating the rpm of said compressing fan as a function of the fill level in the feed chute; and (c) a common control device connected to said fill-level measuring device, said pressure-responsive device and said first and second regulators.

5. An apparatus as defined in claim 4, further comprising a setting device connected to said pressure-responsive device for setting a desired pressure in the pressure-responsive device.

6. An apparatus as defined in claim 4, further comprising a setting device connected to said first regulator for setting a desired rpm in said first regulator.

7. An apparatus as defined in claim 4, wherein said fill-level measuring device comprises two vertically spaced sensors.

8. An apparatus as defined in claim 7, wherein each said sensor comprises an optical barrier.

9. An apparatus as defined in claim 7, wherein each said feed chute has means defining air outlet openings for providing passages for the compressing air stream out of the feed chute; said outlet openings having an upper boundary; further wherein at least one of the optical barriers is situated at a level above said upper boundary.

10. An apparatus as defined in claim 4, further comprising a computer including said common control device and having memories connected to said common control device.

11. An apparatus as defined in claim 10, wherein said computer further comprises an rpm balancing device connected to said common control device.

12. In an apparatus for feeding a plurality of fiber processing machines with fiber tufts, including a common fiber conveying duct, a conveyor fan connected with the duct and arranged for generating a tuft conveying air stream therein; an upstream fiber processing machine having an outlet connected with an inlet of the duct upstream of said conveyor fan; a first motor drivingly connected to said conveyor fan; separate reserve chutes associated with respective said fiber processing machines and being connected to said duct for receiving fiber tufts from said duct, a second motor drivingly connected to said upstream fiber processing machine, a pressure-responsive device situated in said fiber conveying duct, a first regulator connected to said pressure-responsive device and said second motor for regulating the rpm of said upstream fiber processing machine as a function of pressure in the duct; the improvement comprising (a) a fill-level measuring device situated in each said reserve chute;

(b) a second regulator connected to said fill-level measuring device and said first motor for regulating the rpm of said conveyor fan as a function of the fill level in the reserve chutes; and (c) a common control device connected to said fill-level measuring device, said pressure-responsive device and said first and second regulators.

13. An apparatus as defined in claim 12, further comprising a setting device connected to said pressure-responsive device for setting a desired pressure in the pressure-responsive device.

14. An apparatus as defined in claim 12, further comprising a setting device connected to said first regulator for setting a desired rpm in said first regulator.

15. An apparatus as defined in claim 12, wherein said fill-level measuring device comprises two vertically spaced sensors.

16. An apparatus as defined in claim 15, wherein each said sensor comprises an optical barrier.

17. An apparatus as defined in claim 15, wherein each said reserve chute has means defining air outlet openings for providing passages for the conveying air stream out of the reserve chute; said outlet openings having an upper boundary; further wherein at least one of the optical barriers is situated at a level above said upper boundary.

18. An apparatus as defined in claim 12, further comprising a computer including said common control device and having memories connected to said common control device.

19. An apparatus as defined in claim 18, wherein said computer further comprises an rpm balancing device connected to said common control device.

* * * * *